219-121 SR
10/24/78 XR 4,122,240

United States Patent [19] [11] 4,122,240
Banas et al. [45] Oct. 24, 1978

[54] SKIN MELTING

[75] Inventors: Conrad Martin Banas, Bolton; Edward Mark Breinan, Glastonbury; Bernard Henry Kear, Madison; Anthony Francis Giamei, Middletown, all of Conn.

[73] Assignee: United Technologies Corporation, Hartford, Conn.

[21] Appl. No.: 773,889

[22] Filed: Mar. 2, 1977

Related U.S. Application Data

[63] Continuation-in-part of Ser. No. 658,547, Feb. 17, 1976, abandoned.

[51] Int. Cl.[2] ..... C21D 1/06; H05B 7/00
[52] U.S. Cl. ..... 428/655; 148/3; 148/4; 148/13; 148/39; 219/121 EB; 219/121 L; 427/35; 427/53; 428/678
[58] Field of Search ..... 148/1, 3, 4, 13, 32, 148/39; 219/121 EB, 121 L; 427/35, 53; 428/655, 615, 678

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 29/194 |
| 3,926,682 | 12/1975 | Shimada et al. | 148/4 |
| 4,000,011 | 12/1976 | Sato et al. | 219/121 EB |

OTHER PUBLICATIONS

Elliot, et al., "Rapid Cooling by Laser Melt Quenching," App. Phys. Lett., vol. 21, No. 1, Jul. 1972, pp. 23–25.

Laridjani, et al., "Metastable Phase Formation in a Laser-Irradiated Silver-Germanium Alloy," Lo Mat. Sc., 7, (1972), pp. 627–630.

Warlimont, "Extremely Rapid Solidification," Zeitschrift fur Metallkunde," vol. 63, (1972), No. 3, pp. 113–118.

*Primary Examiner*—Arthur J. Steiner
*Attorney, Agent, or Firm*—Charles E. Sohl

[57] ABSTRACT

A surface treatment for a class of metallic articles is described. The treatment involves the melting of a thin surface layer of the article by a concentrated energy source, within a narrow set of parameters. The melting step is performed in a manner which maximizes the temperature gradient between the melted and unmelted portion of the article, consequently, cooling and solidification upon the removal of the energy source is extremely rapid and can produce unique microstructures. The preferred energy source is a continuous wave laser, and in the preferred embodiment, a flowing inert gas cover is used to minimize melt contamination and plasma formation. The technique may be used to produce amorphous surface layers in a specific class of eutectic alloys. In another class of alloys, based on the transition metals and containing precipitates rich in one or more metalloids, uniquely fine microstructures may be produced.

23 Claims, 10 Drawing Figures

SPECIFIC ENERGY, J CM²
10⁶
10⁴
10²
100
SHOCK HARDENING
HOLE DRILLING
DEEP PENETRATION WELDING
SURFACE VAPORIZATION
SKIN MELTING
SURFACE MELTING
SURFACE MELTING
TRANSFORMATION HARDENING
POWER DENSITY - W/CM²
10¹⁰
10⁹
10⁸
10⁷
10⁶
10⁵
10⁴
10³
INTERACTION TIME - SEC.
10⁻⁸
10⁻⁶
10⁻⁴
10⁻²
10⁰

1 100 FPM | 2 100 FPM | 3 75 FPM | 4 50 FPM | 5 25 FPM | 6 20/50 FPM
FIG. 4 (7.5X)
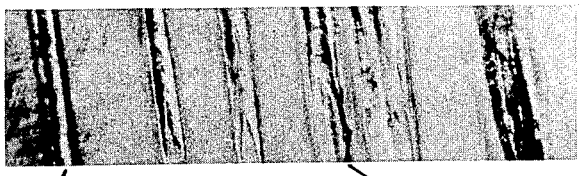
FIG. 5 150X
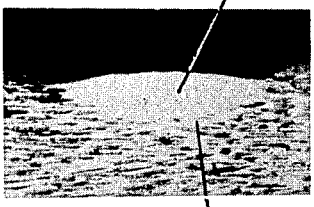
FIG. 6 (100 X)
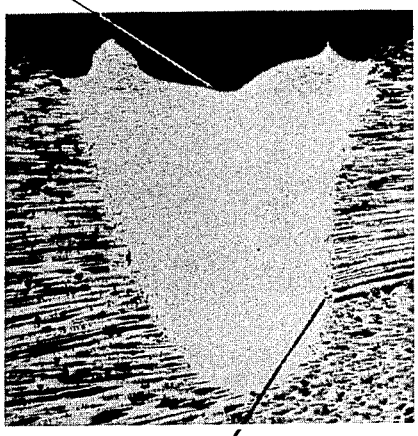
FIG. 7 (1,000X)
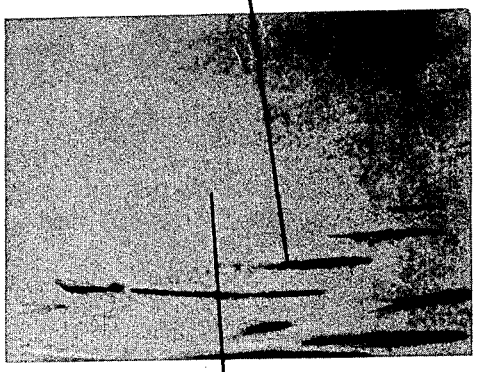
FIG. 8 (1,000X)
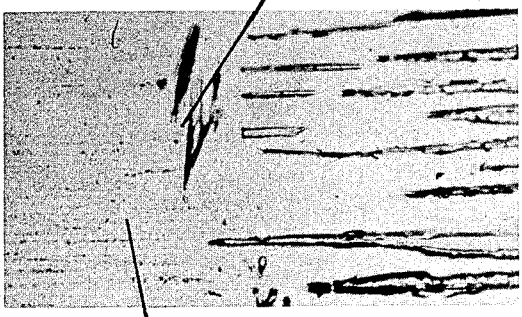
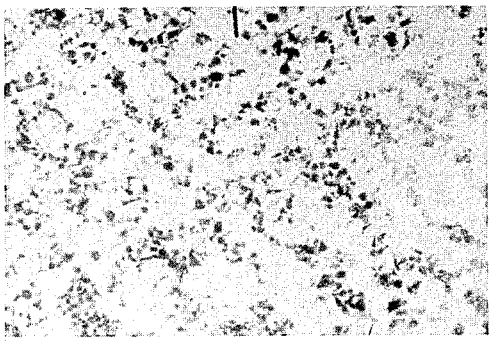
FIG. 9 (33,000 X)
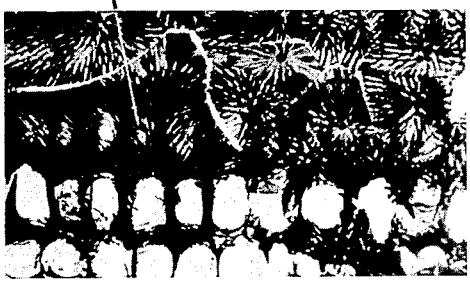
FIG. 10 (13,000 X)

SKIN MELTING

BACKGROUND OF THE INVENTION

This is a continuation-in-part of application Ser. No. 658,547 filed Feb. 17, 1976, now abandoned.

FIELD OF THE INVENTION

This invention relates to a method for producing novel and useful surface properties on a metal article, by using a concentrated source of energy to melt a thin surface layer. The rapid solidification which follows produces unique metallurgical structures.

DESCRIPTION OF THE PRIOR ART

While the metallurgical art is crowded with methods for modifying the surface properties of metal articles, most of these do not involve melting, but are solid state transformations. Although the laser has been used in the field of metallurgy since soon after its invention, the vast majority of laser metal treating operations involve either no melting, as in the transformation hardening of steel or extremely deep melting as in welding and cutting. One general exception to this is the use of lasers in surface alloying, as for example in the fabrication of wear resistant valve seats for internal combustion engines. In this specific case, surface layers, which have been enriched in certain elements, are melted under conditions of relatively low power inputs, to diffuse the surface enrichment elements into the article.

The relationship of the process of the present invention to several common prior art processes is shown in FIG. 1 which is a plot showing absorbed power density on one axis and interaction time of the energy source and the substrate on the other axis. FIG. 1 is based on material having a thermal property of nickel. For other materials having different thermal properties, the different regions would be shifted relative to the axes of the figure but the relationship between the regions would be basically unchanged.

The technique shown as shock hardening uses extremely high power densities and short interaction times to produce a metal vapor cloud which leaves the metal surface with a high enough velocity to create a shock wave at the metal surface. Hole drilling uses a laser to produce holes in materials by vaporization of the substrate by the laser beam. Deep penetration welding uses a moderate power density and a moderate interaction time to produce deep melting in metal articles to be joined. The melting is usually accompanied by the formation of a hollow cavity which is filled with plasma and metal vapor. Finally, transformation hardening is performed at low power densities and long interaction times.

Shock hardening and hole drilling are usually performed using pulsed lasers since pulsed lasers are the most reasonable way to achieve the desired combination of power density and interaction time. Deep penetration welding and transformation hardening are usually performed using a continuous laser and the interaction time is controlled by sweeping the laser beam over the area to be welded or hardened. The region of the present invention is shown as "skin melting". This region is bounded on one side by the locus of conditions where surface vaporization will occur and on the other side by the locus of conditions where surface melting will occur. The other two boundaries of the region of the present invention are interaction times. It is evident from this figure that the process of the present invention involves surface melting but not surface vaporization. It can be seen that the prior art process areas do not overlap the area of the present invention. Transformation hardening is performed at conditions where surface melting will not occur while shock hardening, hole drilling and deep penetration welding all involve a significant amount of surface vaporization.

Three references exist which describe the use of lasers in situations involving surface melting. *Appl. Phys. Letters* 21 (1972) 23–25 describes laboratory experiments in which thin surface zones were melted on non-eutectic aluminum alloys using a pulsed laser. A rapid cooling rate was observed. An experiment in which metastable crystalline phases were produced by surface melting, using a pulsed laser, is described in *J. Mater. Sci.* 7 (1972) 627–630. A similar experiment in which metastable phases were produced in a series of non-eutectic Al-Fe alloys is described in *Mater. Sci. Eng.* 5 (1969) 1–18. These three references all appear to show processes which involve a significant amount of surface vaporization.

An article in *Zeitschrift fur Metallkunde,* Vol. 63 (1972), No. 3, pages 113–118 discusses the general subject of rapid solidification and indicates that high cooling rates might be attained by laser melting. Specific interaction times of $10^{-8}$ seconds are suggested. Again, referring to FIG. 1, it can be seen that this interaction time lies outside the range of the present invention.

SUMMARY OF THE INVENTION

A concentrated energy source is used to rapidly melt thin surface layers on certain alloys. Melting is performed under conditions which minimize substrate heating so that upon removal of the energy source, cooling and solidification due to heat flow from the surface melt layer into the substrate is rapid. Energy input parameters are controlled so as to avoid surface vaporization.

A flowing inert gas cover is used during the melting process so as to eliminate atmospheric contamination and to minimize plasma formation.

By controlling the heat parameters, the melt depth and cooling rate may be varied. High cooling rates may be used to produce amorphous surface layers on certain deep eutectic materials. Lower cooling rates can produce unique microstructures which contain metalloid rich precipitates in transition metal base alloys.

The foregoing and other objects, features and advantages of the present invention will become more apparent in the light of the following detailed description of preferred embodiments thereof as illustrated in the accompanying drawings.

BRIEF DESCRIPTION OF THE DRAWINGS

FIG. 4 shows a macrophotograph of a partially skin melted cobalt alloy surface;

FIG. 5 shows photomicrographs of transverse sections of one of the skin melted regions of FIG. 4;

FIG. 6 shows photomicrographs of transverse sections of another of the skin melted regions of FIG. 4;

FIG. 7 shows a higher magnification photomicrograph of a section of FIG. 6;

FIG. 8 shows a higher magnification photomicrograph of a section of FIG. 6;

FIG. 9 shows an extraction replica from the melt zone of the material shown in FIG. 5;

FIG. 10 shows an extraction replica from the melt zone of the material shown in FIG. 6.

DESCRIPTION OF THE PREFERRED EMBODIMENTS

Figure 1:
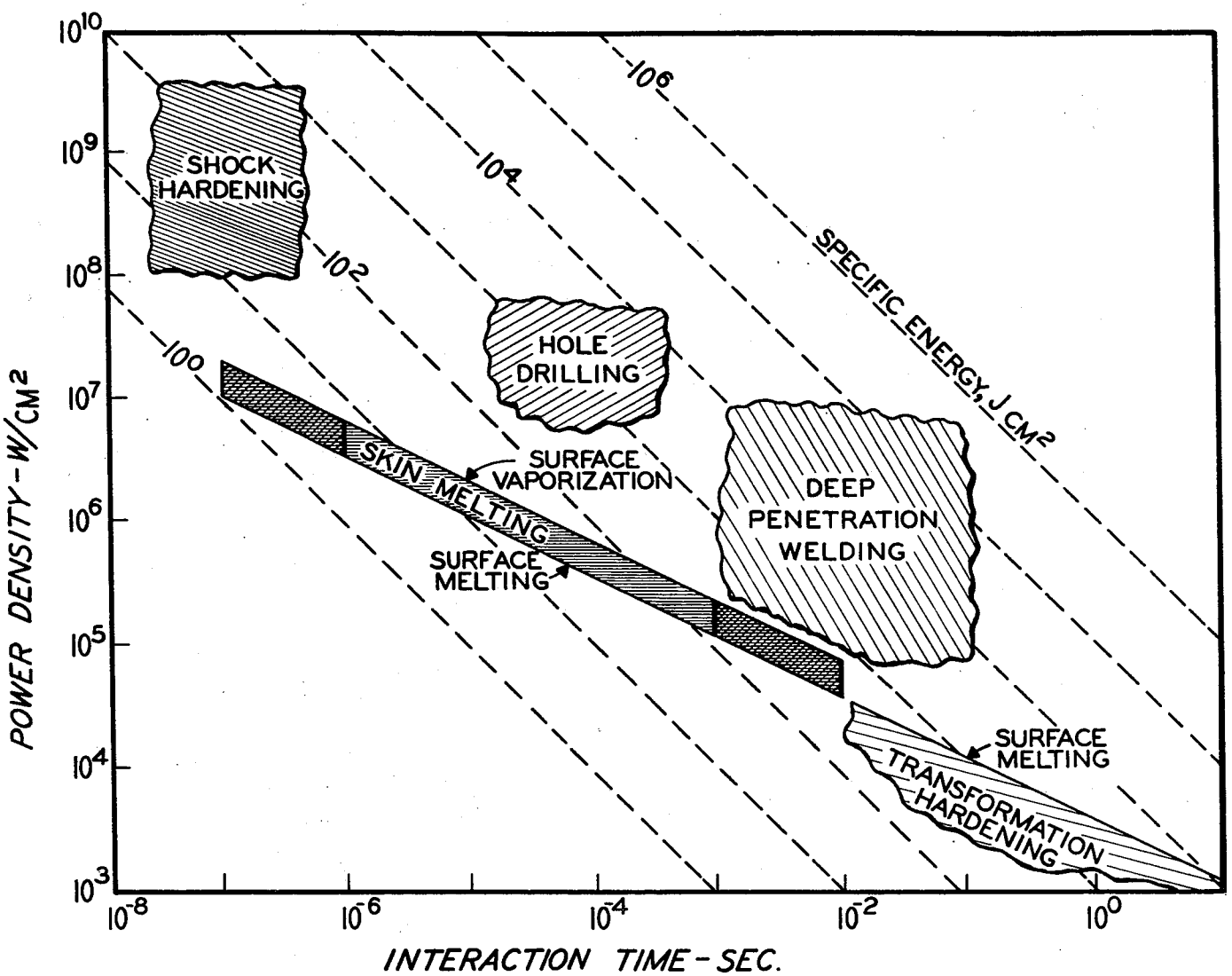
FIG. 1 shows the laser parameters of the invention and certain prior art processes.

Skin melting is a term which has been coined to describe the rapid melting and solidification of a thin surface layer on the surface of a metallic article as a result of highly concentrated energy inputs to the surface. By putting energy into the surface layer at a high enough rate, at a rate which greatly exceeds the rate at which heat can be conducted into the material, the temperature of the surface layer can be raised to above its melting point without significantly increasing the temperature of the underlying bulk substrate, that is to say, high energy inputs can produce steep thermal gradients. Energy input to the surface is limited by the onset of surface vaporization. Thus, when the energy input to the surface is terminated, the thermal energy heat in the melted surface layer will be rapidly dissipated into the cool underlying substrate. Calculations and experiments indicate that cooling rates in excess of about $10^{5}$° C per second may be achieved for melted surface layers which are on the order of 1 to 2 mils in thickness. Of course, the parameters and effective cooling rates generated by the skin melting technique will vary with the thermal properties of the material.

The energy source must satisfy certain criteria. The first criterion is that the energy source must be capable of producing an extremely high absorbed energy density at the surface. For this process, the critical parameter is absorbed energy rather than incident energy. For the case where a laser is used as the energy source, and this is one of the few known energy sources capable of generating the necessary energy densities, the proportion absorbed varies widely with differences in material and surface finish. Another phenomenon which reduces absorbed power is the plasma cloud which forms near the surface during laser irradiation. This plasma cloud absorbs some of the incident energy and also causes defocusing of the beam thus reducing the power density at the surface.

The second criterion is that the absorbed energy must be essentially completely transformed into thermal energy within a depth which is less than about one half of the desired total melt depth. This criterion must be observed in order to ensure that excessive heating of the substrate, and consequent reduction of the cooling rate, do not occur. Subject to this second criterion, electron beam (E.B.) heating may also be used.

Briefly, the invention process is performed as follows: a continuous energy source, having characteristics to be defined below, is used to heat the surface of the article to be treated. Although electron beam techniques may be used, a continuous wave laser is the preferred source. When a laser is used, the point of interaction between the beam and the surface is shrouded with a flowing inert gas to minimize interaction of the surface melt zone with the atmosphere, and to reduce plasma formation. The energy source is then moved relative to the surface to produce the skin melting effect on a continuous basis. Overlapping passes may be used to completely treat an article surface. The incident energy is controlled so that the absorbed energy is sufficient to cause surface melting but less than that required to cause surface vaporization. Interaction times are controlled so as to fall within the range of $10^{-2}$ to $10^{-7}$ seconds, and preferably within the range of $10^{-3}$ to $10^{-6}$ seconds. Experiments were performed which verified this concept. A computer program using finite elements heat flow analysis was then developed and utilized to predict the cooling rates which should be obtained in a particular material (pure nickel) as a function of different conditions.

Figure 2:
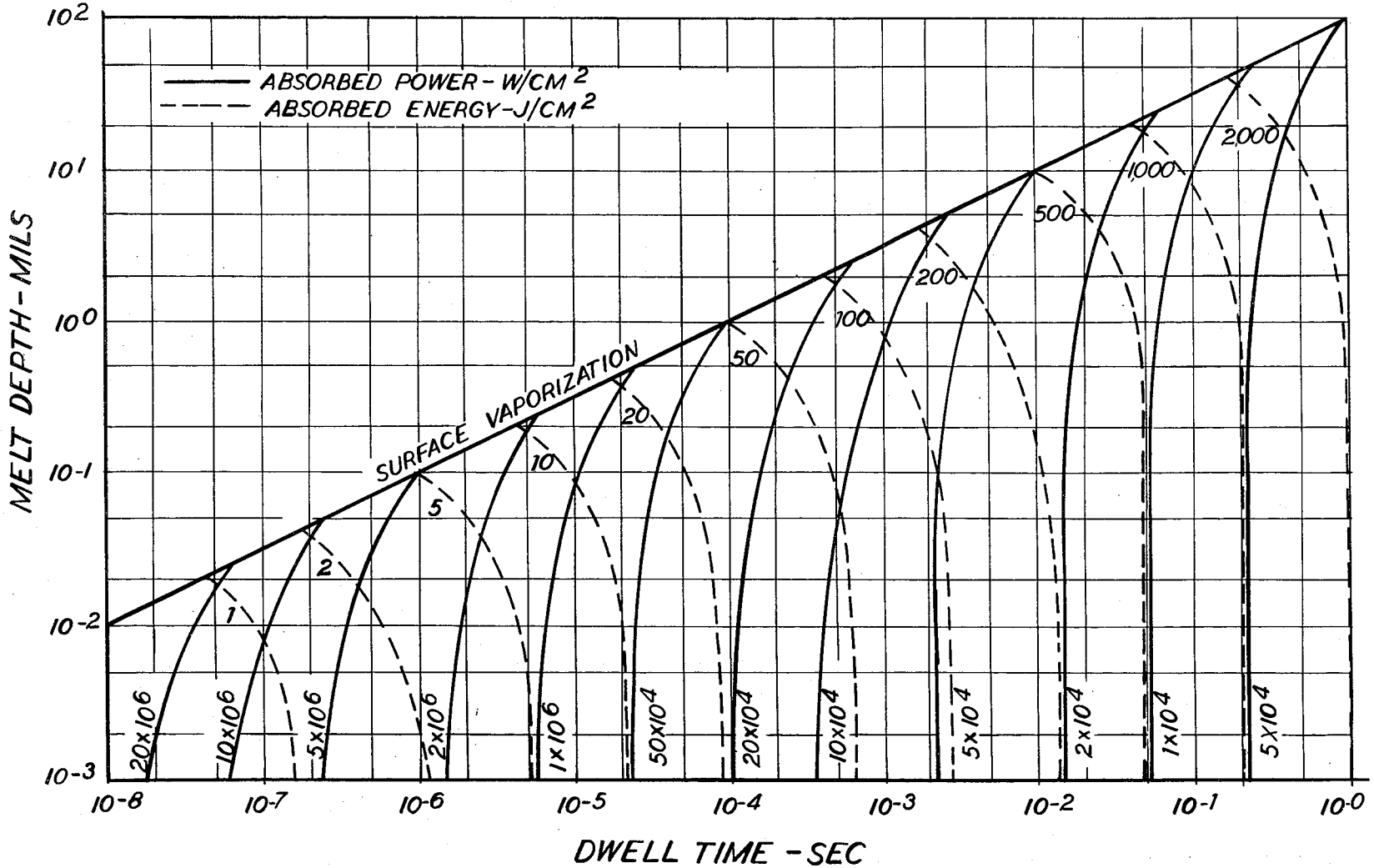
FIG. 2 shows the relationship between power input, heating time, and the resultant depth of surface melt, for laser skin melting.

FIG. 2 shows the interrelationship between absorbed power, duration of power application and resultant melt depth. This figure is based on the thermal properties of pure nickel and assumes that the power source is a laser beam which is absorbed at the surface. This figure has two sets of curves, one relating to absorbed power (watts/sq. cm./sec.) and the other relating to absorbed energy (joules/sq. cm.). For example, it can be seen that if a laser beam with a density sufficient to cause a power absorption of $1\times10^{6}$ watts/sq. cm. were applied to a nickel surface for a time of $10^{-5}$ seconds, the resultant melt depth would be slightly less than $10^{-1}$ mils. Likewise, if a laser beam were used to cause an energy of 1 joule/sq. cms. to be absorbed by a nickel surface in a time of about $10^{-7}$ seconds, a surface melt depth of slightly less than $10^{-2}$ mils would result. This curve points out that when high absorbed power densities are applied to metallic surfaces, controlled melting of surface layers can occur quite rapidly. The energy source used is preferably continuous and is moved relative to the surface being treated. The approximate dwell time may then be calculated from the relationship $$\text{dwell time} = \text{spot size/rate of relative motion.}$$

The dwell time is preferably less than about 0.001 second.

Figure 3:
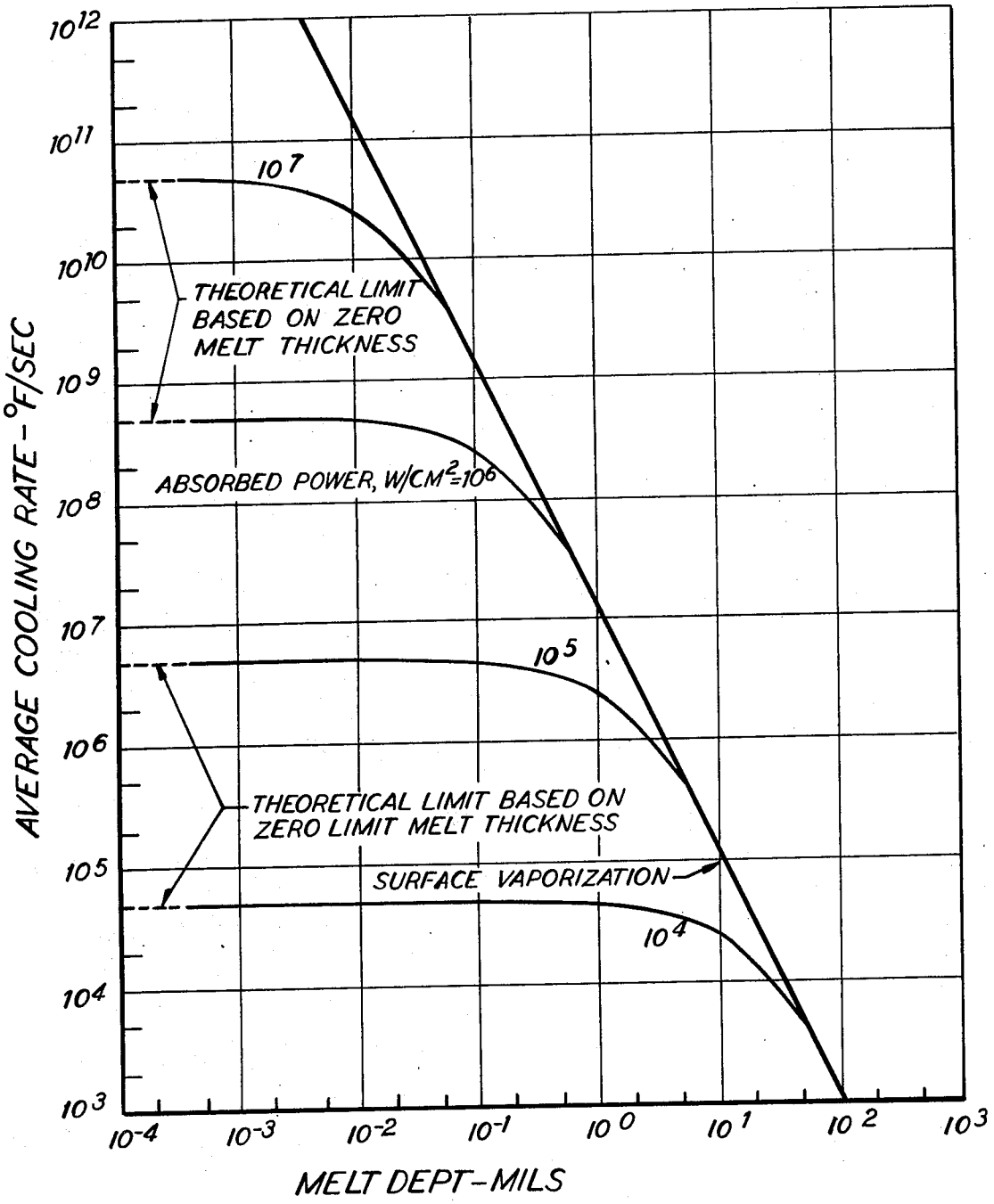
FIG. 3 shows the relationship between surface melt depth and an average cooling rate, for several different power inputs, for laser skin melting.

FIG. 3 shows another family of curves which relate melt depth and absorbed power density to the average cooling rate of the surface melt layer between the melting point and 1500° F. With regard to the example mentioned above, in connection with FIG. 2, of a beam which causes a power absorption of about $10^{6}$ watts/sq. cm., applied to the surface for a time of about $10^{-5}$ seconds, to produce a melt depth of about $10^{-1}$ mils, FIG. 3 indicates that under these conditions the average cooling rate of the melt layer would be about $5\times10^{8}$° F/sec. These cooling rates assume a thick substrate for heat absorption, and the present invention requires that the substrate be at least about 4 times as thick as the melted layer. Such cooling rates are extremely high and can be utilized to produce new and novel microstructures in certain materials.

In the embodiments which follow, the surface layer may or may not have the same composition as the underlying substrate material. A modified composition surface layer may be produced by many techniques known in the metallurgical art including:

a. completely different surface layer may be applied by a variety of techniques which include plating, vapor deposition, electrophoresis, plasma spraying and sputtering. The surface layers thus applied is preferably of substantially eutectic composition and need not have any constituents in common with the substrate;

b. a layer of an element which forms a eutectic with a major element in the substrate may be applied and then caused to diffuse into the substrate by appropriate heat treatments in the solid state. The material may be applied by a wide variety of techniques which include the techniques set forth above in "*a.*";

c. a layer comprised in whole or in part of a material which forms a deep eutectic with a major constituent of the substrate may be applied to the surface of the substrate and melted into the substrate by application of heat, as for example by laser or electron beam, so as to form a surface layer of the desired depth of substantially eutectic composition.

A certain class of materials, defined as deep eutectic materials, may be made amorphous, when the skin melting conditions are sufficient to produce cooling rates in excess of about $10^{6°}$ F/sec. and preferably in excess of about $10^{7°}$ F/sec. A eutectic composition is a mixture of two or more elements or compounds which has the lowest melting point of any combination of these elements or compounds and which freezes congruently. For the purposes of this invention a deep eutectic is defined to be one in which the absolute eutectic temperature is at least 15% less than the absolute melting point of the major eutectic constituent. Referring to FIG. 3 it can be seen that a cooling rate in excess of $10^{6°}$ F/sec. requires an absorbed power density in excess of about $5\times10^4$ watts/sq. cm., and can only be achieved in melt depths of less than about 5 mils. Amorphous surface layers (layers which were more than about 50% amorphous) have been obtained in alloys based on the eutectic between palladium and silicon (in a $Pd_{0.775}$—$Cu_{0.06}$—$Si_{0.165}$ alloy) in which the absolute depression of the eutectic temperature (1073° K), from the absolute melting point of palladium (1825° K) is about 41%.

The previous embodiments have concerned situations in which either an amorphous surface layer or a crystalline surface layer was produced. A third situation exists which produces a microstructure referred to as "phase decomposed". In this embodiment, the surface layer is melted and cools sufficiently rapidly to avoid crystallization at the normal solidification temperature. However, as the super cooled surface layer is further cooled, the driving force for crystallization increases and crystallization occurs at a temperature significantly lower than crystallization occurs at a temperature significantly lower than crystallization would normally occur. Because crystallization occurs at a lower temperature, the resultant crystal size will be much smaller than that produced by normal crystallization. The crystal size will be on the order of 100 A to 1,000 A.

The second class of materials which may be treated by the present process are alloys based on transition metals and which contain an amount of a metalloid in excess of the solid solubility limit. The term metalloid as used herein encompasses C, B, P, Si, Ge, Ga, Se, Te, As, Sb and Be. Preferred metalloids are C, B, and P with B and P being most preferred. Preferred transition elements are Fe, Ni and Co. Under the cooling conditions which result from normal melting and cooling (i.e. rates less than about $10^{3°}$ F/sec.) such alloys contain massive, metalloid-rich particles (having dimensions on the order of microns). Although techniques to control particle morphology during solidification have been developed, notably directional solidification, the dimensions and spacing of the metalloid-rich particles are still on the order of microns. By applying the present invention process to this class of alloys, the size of the metalloid-rich particles can be reduced to less than 0.5 microns and preferably less than 0.1 microns. The cooling rates necessary to effectuate such a microstructural change is at least $10^{4°}$ F/sec. and preferably at least $10^{5°}$ F/sec. From FIGS. 2 and 3, cooling rates of $10^{4°}$ F/sec. and $10^{5°}$ F/sec. can be seen to require power densities of about $5\times10^3$ and $2\times10^4$ watts/sq. cm., respectively. This aspect of the invention may be understood by reference to the figures. FIG. 4 shows a planar view of a cobalt alloy (20% Cr, 10% Ni, 12.7% Ta, 0.75% C, bal. Co) which has been skin melted under the conditions indicated. Prior to skin melting the alloy had been directionally solidified to produce a structure which includes TaC fibers in a cobalt solid solution matrix. FIGS. 5 and 6 are transverse photomicrographs of two of these skin melted passes. FIGS. 7 and 8 are also transverse views, at higher magnification, showing that the carbide (TaC) fiber (dark phase) spacing is about 5–10 microns. FIGS. 9 and 10 are extraction replicas taken from within the skin melted regions of FIGS. 7 and 8, illustrating the changes in carbide morphology which result from skin melting. Because melt depth in FIG. 6 is deeper than in FIG. 5, the FIG. 5 material experienced a higher cooling rate. The dark carbide particles in FIG. 7 are essentially equiaxed and probably formed by precipitation from a super-saturated solid solution after solifification. The carbide size is about .1 microns. FIG. 5 illustrates a different structure, a filamentary carbide structure formed during solidification. The filaments are about 1–2 microns long and about 500 A in diameter. Such structures are extremely hard and are believed unique. Unlike the amorphous layers described earlier, they are relatively stable and are generally not subject to structural changes at elevated temperature. In an alloy based on the nickel-4% boron eutectic, Vickers hardnesses of over 1200 kg/mm$^2$ have been obtained, harder than the hardest tool steels known.

In the process of the present invention, the melt layer is comparatively thin. For this reason, any reaction of the melt with the environment should be avoided, since any surface cleaning process would probably remove a significant portion of the surface layer. Likewise, the present invention depends on controlled surface melting, and any factor which interferes with close control of the melting process should be avoided. When a laser is used as an energy source for the present invention, certain adverse phenomena occur at the point of interaction between the laser beam and the surface being treated. The major adverse reaction is the formation of a plasma cloud. This cloud absorbs a fraction of the beam, reflects another fraction of the beam and tends to defocus the remaining portion of the beam thereby lessening the incident energy density. Because of the factors discussed above, a flowing inert gas cover is an important part of the present process when a laser is the energy source. This gas serves to eliminate adverse surface-environment reaction, and minimizes plasma formation. The gas used should be essentially nonreactive with the (molten) surface layer and should flow at a rate of at least 2 feet per minute at the point of laser-surface interaction. Excellent results have been obtained with a helium-argon mixture at flow velocities of from 2–20 feet per minute.

Although the invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the U.S. is:

1. A surface treatment for metallic articles including the steps of:

a. providing the article surface to be treated on an integral metallic substrate said surface having a substantially eutectic composition;

b. providing a high density energy source, said energy being of a type which is transformed to heat when it strikes a metallic surface;

c. heating the metallic surface to a temperature between the surface melting temperature and the surface vaporization temperature within a time of about $10^{-2}$ to about $10^{-7}$ seconds;

d. allowing the melted surface layer to cool at a rate in excess of $10^{5°}$ C/sec. by conduction into the unmelted substrate.

2. A treatment as in claim 1 wherein the surface heating is performed within a time interval of from about $10^{-3}$ to about $10^{-6}$ seconds.

3. A treatment as in claim 1 wherein the surface composition differs from the bulk composition of the substrate.

4. The product made according to claim 1.

5. The product made according to claim 3.

6. A surface treatment for metallic articles including the steps of:

a. providing a metallic article having a surface integral with a substrate;

b. modifying the composition of at least a portion of the article surface so that the composition is a eutectic;

c. providing a high density energy source, said energy being of a type which is transformed to heat when it strikes a metallic surface;

d. heating the modified metallic surface to a temperature between the surface melting temperature and the surface vaporization temperature within a time of about $10^{-3}$ and about $10^{-7}$ seconds;

e. allowing the melted surface layer to cool at a rate in excess of $10^{5°}$ C/sec. by conduction into the unmelted substrate.

7. A treatment as in claim 6 wherein the modified surface layer is of substantially deep eutectic composition.

8. A treatment as in claim 6 wherein the modified surface layer is based on an element selected from the group consisting of transition metals and mixtures thereof and contains a metalloid selected from the group consisting of C, B, P and mixtures thereof.

9. The product made according to claim 6.

10. The product made according to claim 7.

11. The product made according to claim 8.

12. A treatment for producing a microcrystalline surface layer on alloys based on transition metals which contain significant quantities of certain metalloids including the steps of:

a. providing a metallic article having at least a surface layer based on the group consisting of transition metals and mixtures thereof further containing an amount of a metalloid material chosen from the group consisting of metalloids and mixtures thereof in excess of the solid solubility limit so that metalloid rich precipitates are present under equilibrium conditions, with the surface layer being integral with a metallic substrate;

b. providing a high density energy source, said energy being of a type which is transformed to heat when it strikes a metallic surface;

c. heating the metallic surface to a temperature between the surface melting temperature and the surface vaporization temperature within a time of about $10^{-2}$ and about $10^{-7}$ seconds;

d. allowing the melted surface layer to cool by conduction into the unmelted substrate.

13. A treatment as in claim 12 wherein the surface heating is performed within a time interval of from about $10^{-3}$ to about $10^{-6}$ seconds.

14. A treatment as in claim 12 wherein the surface composition differs from the bulk composition of the substrate.

15. The product made according to claim 12.

16. The product made according to claim 14.

17. The product made according to claim 12 wherein the cooling rate of the melted surface layer is sufficient to suppress crystallization at the normal solidification temperature and crystallization occurs at a lower temperature.

18. A treatment as in claim 1 wherein the energy source is a laser.

19. A treatment as in claim 1 wherein the energy source is an electron beam.

20. A treatment as in claim 6 wherein the energy source is a laser.

21. A treatment as in claim 6 wherein the energy source is an electron beam.

22. A treatment as in claim 12 wherein the energy source is a laser.

23. A treatment as in claim 12 wherein the energy source is an electron beam.

* * * * *

UNITED STATES PATENT AND TRADEMARK OFFICE

CERTIFICATE OF CORRECTION

PATENT NO. : 4,122,240

DATED : October 24, 1978

INVENTOR(S) : CONRAD MARTIN BANAS ET AL

It is certified that error appears in the above–identified patent and that said Letters Patent are hereby corrected as shown below:

| | |
|---|---|
| Column 2, line 44 | "heat" should read -- heating -- |
| Column 4, line 11 | "elements" should read -- element -- |
| Column 5, lines 49 & 50 | "occurs at a temperature significantly lower than crystallization" should be deleted |
| Column 5, line 54 | "A" both occurrences should read -- $\overset{o}{A}$ -- |

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*